US006887052B1

(12) United States Patent
Bush et al.

(10) Patent No.: US 6,887,052 B1
(45) Date of Patent: May 3, 2005

(54) SCROLL WRAP TIP WITH ABRADABLE SELECTIVELY APPLIED COATING AND LOAD-BEARING SURFACE

(75) Inventors: James William Bush, Skaneateles, NY (US); Robert Wilson, Canton, CT (US); Bruce A. Fraser, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 88 days.

(21) Appl. No.: 10/756,016

(22) Filed: Jan. 13, 2004

(51) Int. Cl.[7] ..... F03C 2/00

(52) U.S. Cl. ..... 418/55.2; 418/55.4; 418/55.6; 418/178; 418/1; 29/888.022

(58) Field of Search ..... 418/55.2, 55.1, 418/55.4, 55.6, 178, 147, 149, 107, 1; 29/888.022

(56) References Cited

U.S. PATENT DOCUMENTS 4,460,321 A * 7/1984 Terauchi ..... 418/55.1
4,802,831 A * 2/1989 Suefuji et al. ..... 418/55.2
5,035,589 A * 7/1991 Fraser et al. ..... 418/55.2
5,727,934 A * 3/1998 Sekita et al. ..... 418/55.2
6,079,963 A * 6/2000 Endo et al. ..... 418/55.2

FOREIGN PATENT DOCUMENTS

JP 59208187 A * 11/1984 ..... F04C/18/02

* cited by examiner

*Primary Examiner*—Theresa Trieu
(74) *Attorney, Agent, or Firm*—Carlson, Gaskey & Olds

(57) ABSTRACT

A scroll compressor is provided with a generally spiral wrap having an abradable or conformable coating on radially inner portions of its tip. The coating is not applied to radially outer portions. During operation of the scroll compressor, the coating will eliminate tip gap leakage adjacent radially inner, higher discharge pressure portions of the compression process. The outer, non-coated portions will bear the axial load, and ensure the coating will not wear away to an undue amount.

9 Claims, 2 Drawing Sheets

SCROLL WRAP TIP WITH ABRADABLE SELECTIVELY APPLIED COATING AND LOAD-BEARING SURFACE

BACKGROUND OF THE INVENTION

This invention relates to a scroll compressor utilizing an abradable coating over a portion of its wrap only such that the abradable coating will provide a tight tip seal, but the uncoated portions of the wrap will provide a load-bearing surface.

Scroll compressors are becoming widely utilized in refrigerant compression applications. In a scroll compressor, first and second scroll members each include a base and a generally spiral wrap extending from the base. The wraps interfit to define compression chambers. One of the two wraps is caused to orbit relative to the other, and as the two orbit, the compression chambers are decreased in volume, thereby compressing an entrapped refrigerant.

In scroll compressors, the tip of each wrap is ideally in contact with the base of the opposed scroll member. A prior art scroll compressor is shown in FIG. 1. In prior art scroll compressor 20, the orbiting scroll 22 is placed into operable relationship with the non-orbiting scroll 24. The orbiting scroll 22 has a wrap 26 extending from its base 27. The wrap 26 contacts the opposed base 29 of the non-orbiting scroll 24. The wrap 28 from the non-orbiting scroll 24 contacts the base 27. Ideally, the tips of the wraps are in abutting contact with the opposed bases.

However, as shown in FIG. 2, it is often the case that local height variation along the wrap length may prevent sealing contact with the floor of the opposed base. The leakage sensitivity to a given gap is greater near the center of the wrap in that pressure will be higher adjacent the center. This leakage over the tip of the scroll compressor and through the gap 23 is undesirable and reduces efficiency.

Scroll compressors have been proposed wherein a coating has been applied along the entire wrap. However, this has undesirable characteristics.

SUMMARY OF THE INVENTION

In the disclosed embodiment of this invention, an abradable or conformable coating is applied to a scroll wrap tip only adjacent radially inner portions of the wrap. Radially outer portions of the wrap remain uncoated, and provide a load-bearing surface. In this way, the coating is not subject to bearing the load, but still eliminates the tip gap problem, and in particular at the more central portions of the compression process.

In a disclosed embodiment, a step is formed into the wrap adjacent its center such that it is slightly shorter than the outer portions. Outer portions of the wrap remain uncoated. A coating is placed within the stepped area such that the surface of the coating is slightly taller than the outer portions of the wrap. As the scroll begins to operate, the abradable or conformable coating abrades or flows away leaving a smooth surface which will eliminate any tip gap adjacent the center portion of the wrap. As the coating abrades or flows away, the uncoated outer portions come into contact and provide a load-bearing surface so that the coating is not entirely abraded or worn away.

These and other features of the present invention can be best understood from the following specification and drawings, the following of which is a brief description.

DETAILED DESCRIPTION OF THE PREFERRED EMBODIMENT

Figure 3:
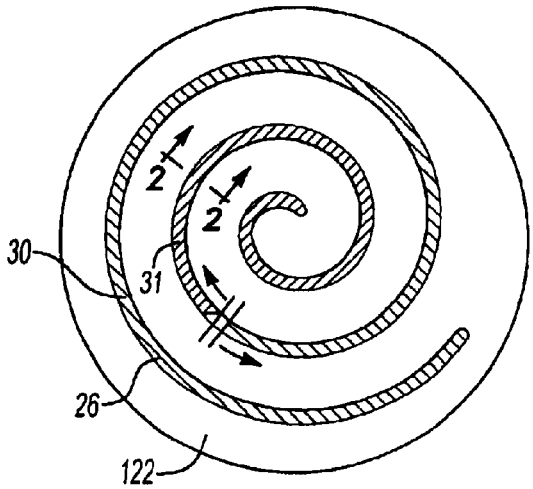
FIG. 3 shows an inventive scroll wrap.

A scroll 122 is illustrated in FIG. 3. The wrap 26 has an outer portion 30 which is formed of a metal such as iron, and is as typically known in the current art. A radially inner center portion 31 is provided with an abradable or conformable coating. While any appropriate coating may be applied, examples of appropriate abradable or conformable coatings include iron phosphate coatings, magnesium phosphate coatings, nickel polymer amalgams, and other materials that abrade or yield plastically when a force is applied. The coated scroll 122 may be on either the orbiting or non-orbiting scroll, or both.

The scroll compressor has a load-bearing surface borne by the metal portion 30 at its uncoated outer peripheral locations. The abradable or conformable coating provides a tight tolerance fit between the tip and the opposed base wall adjacent its central portion. The problem shown in FIG. 2 becomes particularly pronounced at radially inner locations where the pressure between the adjacent chambers H and L is most pronounced. As the pressure of the high pressure chamber H increases, the amount of leakage through the gap 23 to the low pressure chamber L increases. Thus, having the coating at the radially inner or central portions eliminates the leakage at the most effective locations.

Figure 4:
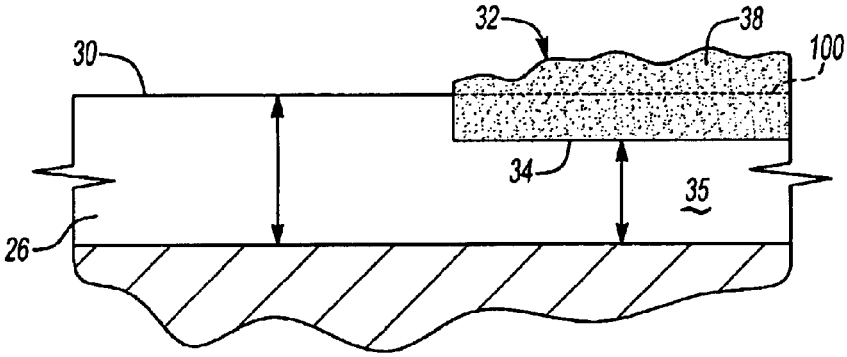
FIG. 4 shows a first step in forming the inventive scroll wrap.

As shown in FIG. 4, a step 34 is cut into the wrap. A portion 35 of the wrap remains formed of the metal adjacent the central portion. A coating 38 is deposited into the stepped portion. As can be seen at 100, the coating surface 32 would initially extend beyond the nominal height of the outer portion 30.

Figure 1:
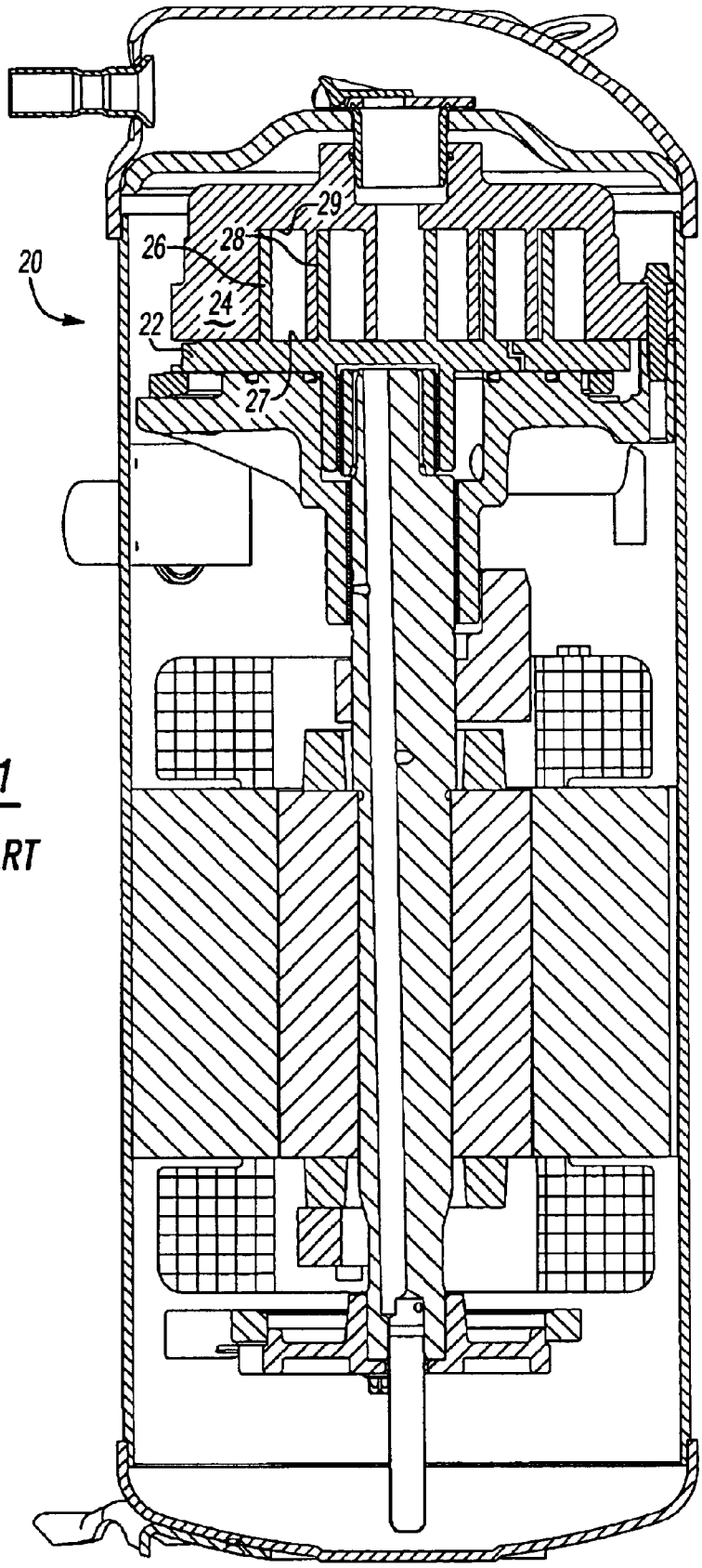
Fig-1 PRIOR ART
FIG. 1 shows a prior art scroll compressor.
Figure 2:
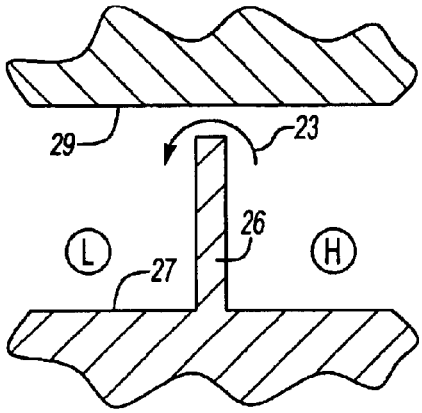
Fig-2 PRIOR ART
FIG. 2 shows a problem in the prior art scroll compressor.
Figure 5:
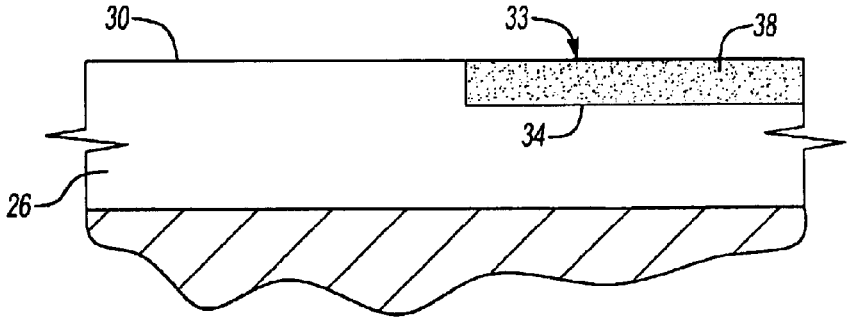
FIG. 5 shows the final configuration for the inventive scroll wrap.

During run-in, the compressor begins to operate, this abradable or conformable coating 38 will wear away such that it eventually has the final shape shown in FIG. 5 at 33. After run-in, this coating would thus eliminate the tip gap problem as shown in FIG. 2. However, as the conformable coating is deformed or worn away, the uncoated harder metal outer portions 30, come into contact and provide a load-bearing surface, and thus complete wear-out of the coating 38 will be prevented.

The coatings that are most suited for this application could be generically described as a coating which will move when the coated scroll member is brought into contact with the mating surface. For purposes of this application, this would mean that when the scroll tip is brought into contact with the opposed mating scroll floor, the coating will move to take on the shape defined by the floor, and eliminate the gap. The coating could be a "conformable" coating that, under the influence of pressure or relative motion from the opposed mating scroll member, will take on a shape defined by the mating member. The coating will typically have a bulk hardness or strength which is somewhat less than that of the mating floor of the opposed scroll member, and for that matter, also of the material utilized to form the scroll tip on which it is deposited. Composite coatings may be utilized which could be made up of two or more mechanically bonded components. As an example, a carbon fiberfill resin, although this particular example would be a somewhat unlikely example. In such a composite, one or more of the coating components may have a hardness or strength equal to or greater than the scroll members, but the aggregate of the two would result in the coating having a hardness or strength that is less than that of the scroll members.

Another example of a conformable coating would be an extrudable or deformable coating. This is a type of conformable coating which when brought into contact with the mating surface and under the influence of pressure and/or relative motion, plastically extrudes or flows until it takes on a shape defined by the mating surface. This type of coating typically does not wear or flake away. The coating material remains attached to the coated tip. Such coatings are often of a composite type with a harder matrix material to provide structural integrity and a softer filler component to lower the bulk hardness and allow the material to flow. Such materials have been utilized, as an example, in screw compressors wherein a known coating was a nickel-polymer aggregate. In such a coating, a nickel "foam" is filled with a soft polymer material. Open metal foams may be desirable for this application. However, such forms may also have some difficulty in that parts of the metal foam may sometimes break away, which could result in undesirable abrasive debris. In the known nickel-polymer aggregate, the polymer nodules provide an internal hydrostatic-type support to prevent the metal matrix from bending too much locally, which provides the benefit of good bond strength holding the deformed metal in place.

Another type of coating within the scope of this invention is an abradable coating. This is a type of coating that wears or flakes away under the influence of pressure and/or shape from the mating floor of the opposed scroll member. Such coatings tend to be soft, and if they are formed of a composite, all of the components are typically soft. The wear debris will circulate through the rest of the compressor mechanism, and it would be undesirable to have an unduly abrasive "grit" provided by such an abradable coating.

For purposes of this application, the above coatings are generally referred to as coatings that will change their shape upon the influence of the opposed mating floor of the opposed scroll member. In that sense, the material of the coating will move upon contact with the floor of the mating scroll member. This "changing" and "movement" can be abrasion or the type of movement without abrasion provided by a conformable coating.

While a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A method of forming a scroll compressor comprising the steps of:

(1) providing first and second scroll members, with each of said scroll members including a base and a generally spiral wrap extending from said base;

(2) providing an abradable coating on a tip of said wrap of at least one of said first and second scroll members, with said coating being a coating material which will change its shape when it encounters the mating surface of the other of said first and second scroll members, and formed only at radially inner portions of said generally spiral wrap, with radially outer portions left uncoated; and (3) causing said second scroll member to orbit relative to said first scroll member with a surface of said coated tip moving along a floor of said base of the other of said first and second scroll members such that said coating moves to match said floor and results in a tight tolerance between said tip of said scroll wrap and the floor of said base of the other of said first and second scroll members.

2. A method as set forth in claim 1, wherein both said first and second scroll members are provided with said coating at radially inner portions of said generally spiral wrap.

3. A method as set forth in claim 1, wherein said coating is made of an abradable material such that said coating abrades away during the movement of step (3).

4. A method as set forth in claim 1, wherein said coating is a conformable coating such that the coating material conforms to the shape of said floor of said base of the other of said first and second scroll members during step (3).

5. A scroll compressor comprising:

a first scroll member having a base and a generally spiral wrap extending from said base;

a second scroll member having a base and a generally spiral wrap extending from its base, said second scroll member being caused to orbit relative to said first scroll member; and said wraps of at least one of said first and second scroll members including a coating on a tip, and at radially inner portions of said generally spiral wrap, with said generally spiral wrap having radially outer portions which remain uncoated, said coating being formed of a coating material which will change its shape when it encounters the mating surface of the other of said first and second scroll members, such that as said second scroll member is caused to orbit relative to said first scroll member, said coating moving to result in a close tolerance fit between said tip of said generally spiral wrap and an opposed floor of said base of the other of said first and second scroll members, with radially outer portions of said wrap bearing an axial force between said first and second scroll members.

6. A scroll compressor as recited in claim 5, wherein both said first and second scroll members have a generally spiral wrap with inner coated portions and outer non-coated portions.

7. A scroll compressor as recited in claim 5, wherein said wrap has a stepped area extending into a face of said wrap, and said coating being deposited into said stepped area.

8. A scroll compressor as recited in claim 5, wherein said coating is an abradable coating.

9. A scroll compressor as recited in claim 5, wherein said coating is a conformable coating.

* * * * *